United States Patent [19]

Anderson

[11] 4,351,176

[45] Sep. 28, 1982

[54] BENDING BRAKE HEMMER

[76] Inventor: Carl Anderson, 12 St. Stephens Pl., Staten Island, N.Y. 10306

[21] Appl. No.: 143,507

[22] Filed: Apr. 24, 1980

[51] Int. Cl.[3] ..... B21D 5/04

[52] U.S. Cl. ..... 72/322; 72/319

[58] Field of Search ..... 72/319, 320, 322, 323, 72/321

[56] References Cited

U.S. PATENT DOCUMENTS

| | | | |
|---|---|---|---|
| 316,461 | 4/1885 | Huber | 72/310 |
| 505,567 | 9/1893 | Douglas | 72/319 |
| 992,038 | 5/1911 | Noyes | 72/320 |
| 2,016,981 | 10/1935 | Berliner et al. | 72/321 |
| 2,302,958 | 11/1942 | Jensen | 72/319 |
| 3,559,444 | 2/1971 | Blazey et al. | 72/320 |
| 3,592,037 | 7/1971 | Van Cleave | 72/319 |
| 3,913,370 | 10/1975 | Break | 72/319 |
| 4,092,841 | 6/1978 | Chambers | 72/320 |

FOREIGN PATENT DOCUMENTS

| | | | |
|---|---|---|---|
| 697860 | 11/1964 | Canada | 72/320 |
| 600982 | 4/1948 | United Kingdom | 72/321 |

*Primary Examiner*—Daniel C. Crane

[57] ABSTRACT

A bending attachment for installation in the jaws of a conventional portable bending brake for the additional bending of a previously partially bent sheet material workpiece. The bending attachment includes a horizontally oriented elongated base section which can be mounted in the jaws of the conventional portable bending brake. A workpiece holding sectional vertically upstands from the proximal edge of the base section and is in a substantially inverted U-shaped cross section.

6 Claims, 4 Drawing Figures

BENDING BRAKE HEMMER

BACKGROUND OF THE INVENTION

This invention relates to a portable bending brake and more particularly to a bending attachment for a conventional portable bending brake in order to provide additional bending of a previously partially bent sheet material workpiece.

Portable bending brakes are commonly available for bending workpieces of sheet material through a range of angles typically varying from 0° to 120°, and generally limited to approximately 110°. Such portable bending brakes are utilized in numerous industries, such as in connection with the installation of aluminum siding onto the exterior of homes. The siding is generally manufactured to be directly installed. In some cases vinyl siding is utilized. However, in almost all situations aluminum trim is utilized to finish off specific areas such as doors and windows, corner edges, moldings, etc. The aluminum sheet material utilized as the trim is generally bent insitu in order to achieve the proper size and fit. The portable bending brake is set up at the job site and the elongated strips of sheet material are bent into the desired shape. For many applications, conventional portable bending brakes are sufficient since the desired bent angle is usually approximately 90°.

However, for some applications it is necessary to provide a bend greater than 120° and typically a complete 180° bend is required. These situations arise especially when it is desired to form a hem at one edge of the sheet material workpiece.

Supplemental bending attachments for use with conventional portable bending brakes have been previously suggested in the prior art. One such attachment is described in U.S. Pat. No. 3,913,370. The bending attachment provides for an upstanding stationary clamping member which has a horizontal base portion for mounting in the conventional portable bending brake jaws. A movable workpiece clamping member is pivoted with respect to the stationary clamping member intermediate the upper and lower ends thereof and is movable towards and away from the stationary clamping member. Pivoted to one of the clamping members near its upper end above the pivotal connection between the clamping members, is a movable locking member movable into and out of locking engagement with the upper portion of the other clamping member so as to hold one part of the previously bent workpiece immovably therebetween while performing a supplemental bending operation upon another part of the workpiece by manual upswinging of the bending door of the conventional portable bending brake.

In utilizing the attachment of the aforementioned patent, the attachment is set up apart from the conventional portable bending brake. The locking member is lifted so as to permit pivoting of the movable clamping member from the stationary clamping member. The previously bent workpiece is inserted between the two clamping members and the movable clamping member is then closed onto the workpiece and the movable locking member is placed into locking engagement to provide a tight clamping of the previously bent workpiece in the bending attachment. The entire bending attachment, with the workpiece loaded therein, is then inserted into the jaws of the conventional bending brake and the door of the bending brake is pulled upward to provide the additional bend desired.

Although such supplemental bending attachment has been suggested, its use has been limited because of various drawbacks. Firstly, the bending attachment is a complex device which has numerous movable parts which must be carefully manipulated and accordingly requires special training and skill to operate. Additionally, since the bending attachment is loaded with the workpiece outside of the conventional bending brake, it is cumbersome and quite heavy to take the loaded bending attachment and subsequently insert it into the jaws of the conventional bending brake. In many cases, the length of the sheet material workpiece may be as much as 12'6" and it is quite difficult for one person to insert the loaded bending attachment into the jaws of the conventional bending brake.

An additional limitation of the aforedescribed bending attachment concerns the spacing between the movable and stationary clamping member. Since these two members are locked together by means of a fixed locking member, the spacing between the movable and stationary clamping members is fixed. As a result, should an extremely thin sheet material workpiece be utilized, it may not be suitably clamped when the locking member is closed. On the other hand, if the sheet material workpiece is very thick, the bending attachment may not be able to lock at all and accordingly will not be able to clamp down onto the sheet material workpiece. This problem is further complicated when it is desired to provide a double folded over hem onto a sheet material workpiece. Even assuming that the aforedescribed bending attachment can accommodate a single thickness of sheet material in order to provide a single folded over hem of 180°, in order to provide the double folded over hem, the double thickness of the sheet material workpiece must now be inserted. Such double thickness will be too thick to be accommodated by the bending attachment and accordingly it will not be possible to utilize the same bending attachment for both a single and double folded over hem.

It is believed that one reason that the aforedescribed bending attachment is a complex device, is that it had previously been assumed that it was necessary to securely clamp the workpiece in the bending attachment prior to insertion into the jaws of the conventional bending brake. As a result, a complex locking mechanism was provided in order to hopefully get adequate clamping onto the workpiece. It is believed for this reason the aforementioned bending attachment had the various complex parts of the device necessary and required loading of the bending attachment prior to insertion on the portable bending brake.

SUMMARY OF THE INVENTION

It has now been determined that it is possible to provide a bending attachment for a portable bending brake which does not necessarily have to clamp onto the workpiece. Furthermore, it has been found possible to insert the bending attachment into the portable bending brake in an unloaded condition and load the previously bent workpiece into the bending attachment while it is already in the conventional bending brake. As a result, secure clamping of the workpiece is eliminated and a simplified bending brake is provided.

It is accordingly an object of the previous invention to provide a supplemental bending attachment for a conventional portable bending brake which avoids the aforementioned problems of prior art devices.

Yet another object of the present invention is to provide a bending attachment for installation in the jaws of a conventional portable bending brake for the additional bending of a previously partially bent sheet material workpiece.

Yet another object of the present invention is to provide a bending attachment for use with a conventional portable bending brake which is simplified in construction, easy to utilize, simple to manipulate, requires no specialized skill or training, is easy to manufacture, and facilitates the supplemental bending operation.

Still another object of the present invention is to provide a bending attachment for installation in a conventional portable bending brake which retains the previously bent workpiece without necessarily clamping onto the workpiece.

Yet a further object of the present invention is to provide a bending attachment for a conventional portable bending brake wich can accommodate different thicknesses of sheet material.

A further object of the present invention is to provide a bending attachment for use with a conventional portable bending brake which permits the formation of a double folded over hem onto the edge of a sheet material workpiece.

Another object of the present invention is to provide a bending attachment for use with a conventional portable bending brake which permits installation of the bending attachment into the bending brake and subsequently loading the workpiece into the bending attachment while it is in the conventional bending brake.

Still a further object of the present invention is to provide a method of further bending a sheet material workpiece which has been previously partially bent in a conventional portable bending brake.

Another object of the present invention is to provide a method for providing an additional bend onto a sheet material workpiece by first partially installing a bending attachment into the conventional portable bending brake and then loading the workpiece into the partially installed bending attachment.

These and other objects, features, and advantages of the invention will, in part, become clarified by the following description of the invention.

Briefly, in accordance with the present invention, there is provided a bending attachment for installation in the jaws of a conventional portable bending brake for the additional bending of a previously partially bent sheet material workpiece. The attachment includes a horizontally oriented elongated base section for mounting in the jaws of the conventional portable bending brake. A workpiece holding section vertically extends from the proximal edge of the base section. The workpiece holding section includes two fixed elongated legs interconnected to form a substantially inverted U-shape in cross section. The lower edge of the rearward leg is interconnected to the proximal base edge.

The invention further contemplates a method of utilizing the aformentioned bending attachment by first lowering the conventional bending door of the bending brake to a position wherein the door edge is in front of the jaws of the bending brake. The elongated base section is then inserted into the jaws of the bending brake. The bending attachment is then angularly oriented with respect to the jaws so that a portion of the bending attachment angularly crosses the door edge to lie forward thereof. One edge of the partially bent workpiece is then upwardly fed between the vertical legs of the workpiece holding section in order to load the bending attachment. The bending attachment is then completely inserted into the jaws of the conventional bending brake and the bending door is lifted up to further bend the workpiece.

BRIEF DESCRIPTION OF THE DRAWING

In the drawing.

In the various figures of the drawing, like reference characters designate like parts.

DESCRIPTION OF THE PREFERRED EMBODIMENTS

Figure 1:
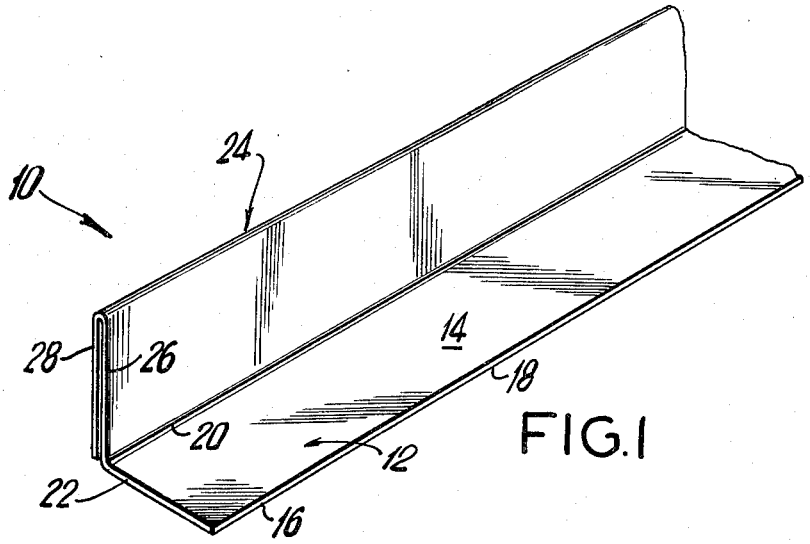
FIG. 1 is a fragmentary perspective view of the bending attachment of the present invention.

Referring now to FIG. 1, the bending attachment of the present invention is shown generally at 10 and includes an elongated base section 12 which is horizontally oriented and is available for mounting in the jaws of the conventional portable bending brake. The base section includes an upper surface 14 and a lower surface 16 having a rear edge 18 and a forward proximal edge 20. One side edge 22 is shown, however, the other edge would continue at the opposing end, which is not shown. The length of the base section may vary, however is conventionally in the order of 12'6" long in order to accommodate lengths of workpieces being bent.

Vertically upstanding from the base section is the workpiece holding section 24. As can best be seen in FIG. 3 the workpiece holding section 24 comprises two vertical legs 26, 28, separated by a workpiece receiving space 30 and interconnected through a bight section 32 to form a substantially inverted U-shaped configuration in cross section. The lower edge 34 of the rearward leg 26 is interconnected at the proximal edge 20 of the base section 12.

Typically, both the workpiece holding section and the base section can be formed of one continuous piece of sheet material so that the workpiece section will be integral with the base section. The material of the bending attachment can typically be aluminum or other such similar rigid but resilient material. Accordingly, although the vertical legs 26, 28 are fixed, the spacing between them can be varied to accommodate different thicknesses of material workpieces, as will hereinafter be discussed.

Figure 3:
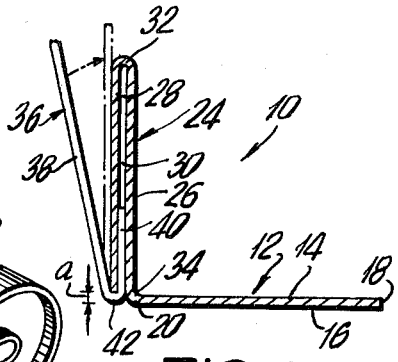
FIG. 3 is a vertical cross section showing the workpiece inserted into the bending attachment.

As shown in FIG. 3, a workpiece, shown generally at 36 includes a first leg 38 and a second leg 40 with a bend 42 formed therebetween. The initial bend between the two legs of the workpiece can be done on a conventional portable bending brake which will provide angles up to approximately 120°, and more typically up to 110°. By inserting one of the legs, specifically shown as the leg 40, in the workpiece receiving space 30 of the bending attachment 10, the angle between the legs of the workpiece can be bent further, and up to 180 degrees.

Figure 2:
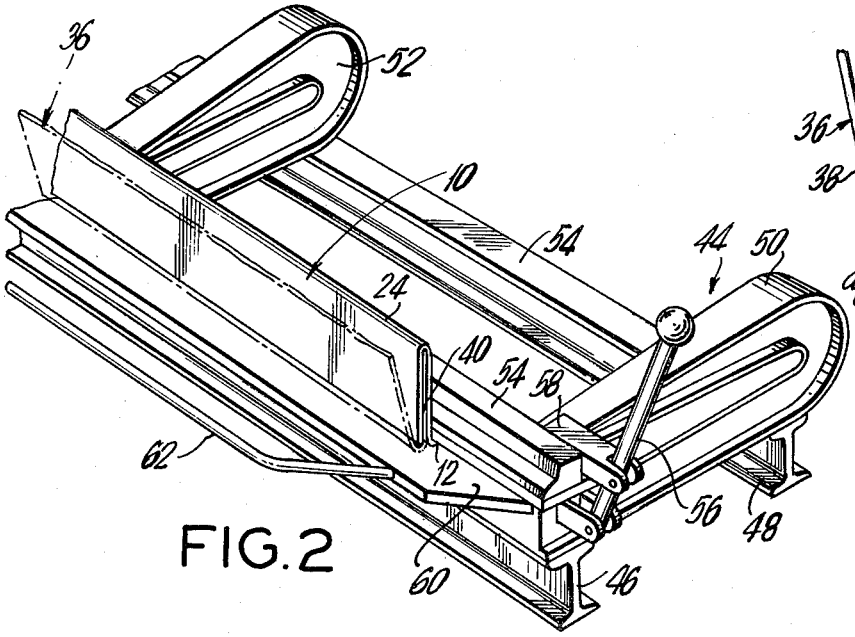
FIG. 2 is a fragmentary perspective view of a conventional portable bending brake with the bending attachment of the present invention mounted therein and with the workpiece mounted in the bending attachment and ready to be bent further.

The bending attachment 10 as heretofore described, can be used in conjunction with a conventional portable bending brake, as is shown at 44, in FIG. 2. The conventional bending brake typically is mounted on I-beams 46, 48 and includes the support arms 50, 52 which are held spaced apart by means of the support rod 54. Connected at the forward edge of the arms 50, 52 are contained the jaws, including the movable upward clamping jaw 54 which moves away from a lower clamping jaw (not shown). The actuator 56 is utilized to open the jaws by moving it to the right within support member 58. The conventional bending is achieved by upward movement of the bending door 60 utilizing the handle 62.

As is shown in FIG. 2, the bending attachment has been inserted between the jaws of the conventional bending brake with the elongated base section 12 positioned between the jaws and the vertically upstanding workpiece holding section 24 upwardly standing from the jaws. The workpiece 36 is shown in dotted line and would have one leg thereof inserted within the space 30 contained between the legs 26, 28 of the workpiece holding section of the bending attachment. By upward movement of the door 60, the additional bend would be placed in the workpiece and specifically up to 180° if desired.

The method of utilizing the bending attachment can best be described in connection with FIG. 4. Initially, the workpiece is inserted in the conventional portable bending brake and the handle 62 is utilized to pull upward on the door 60 so as to bend the workpiece to the desired angle up to approximately 110°–120°. The workpiece is then removed from between the jaws of the bending brake by manipulating the lever 56. The workpiece is then removed from between the jaws by means of the lever 56 and the bending door 60 is lowered so that the back wall 64 is positioned adjacent to the jaws of the bending brake.

Figure 4:
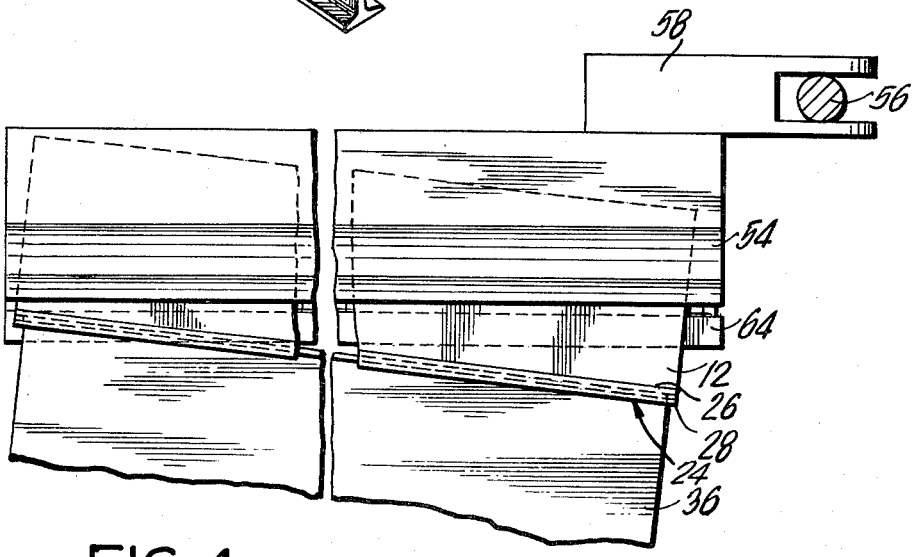
FIG. 4 is a fragmentary plan view showing the method of inserting the workpiece into the bending attachment with the bending attachment already positioned in the conventional bending brake.

The bending attachment of the present invention is then partially inserted between the jaws and angularly positioned so that it angularly crosses the door edge with a portion thereof being located forward of the door edge, as shown in FIG. 4. The workpiece which has been previously bent is then upwardly fed into the workpiece receiving opening 30 between the two legs 26, 28 of the workpiece holding section. As the workpiece is upwardly fed into this space, the bending attachment is slid inwardly so that the rear edge 64 of the door serves as a support for the workpiece. The workpiece is continuously fed upward and as it is inserted in the opening the bending attachment is eased inwardly so that the door continues to support more of the workpiece. .

After all of the workpiece has been upwardly fed so as to lie in suitable position in the bending attachment, the bending attachment is finally pushed into place between the jaws and the jaws locked onto the workpiece by means of the lever arm 56. The door handle can then be moved upwardly to complete the bending of the workpiece to a desired angle up to 180°.

In case the workpiece is of exceptional length and is difficult to upwardly feed in parallel with the bending attachment, it is possible to feed the workpiece in from one edge and slide it longitudinally through the bending attachment until it is positioned in place. Again the edge of the door 64 will support the workpiece as it is being slid into the workpiece opening in the bending attachment and the bending attachment is then pushed into place with the workpiece in it.

By utilizing the aforementioned procedure, it should be appreciated that it is not necessary to load the bending attachment before insertion into the conventional portable bending brake. Instead, the bending attachment is inserted into the portable bending brake and then loaded with the workpiece so that the bending brake provides support for the workpiece as it is being loaded. This accordingly avoids the cumbersomeness, the weight, and the difficulty in placing the loaded bending attachment into the portable bending brake as was required in the prior art device.

It should further be appreciated that the present invention does not require any clamping action onto the workpiece by means of the bending attachment. The workpiece is inserted into the opening provided in the bending attachment but is not clamped into place. Such clamping is eliminated firstly because it has now been found that such clamping is not necessary to provide the additional bend. Furthermore, since the loading can take place with the bending attachment in the portable bending brake, no clamping is needed. Furthermore, by means of the particular design of the present bending attachment, no such clamping is needed and yet appropriate bending as desired can be achieved.

The design of the bending attachment is unique in various respects. It should firstly be noted that the workpiece holding section is vertically oriented with respect to the base. This is contrary to prior art devices which it had been assumed that an angular orientation is needed between the bending section and the supporting base. A second factor concerns the respective length of the two legs forming the workpiece holding section. As shown in FIG. 3, the lower edge of the forward leg 28 is spaced above the plane of the underside 16 of the base section 12 by a distance a. This distance proximates the thickness of the sheet material workpiece. Typically, such thickness is about 0.030 inches. However, it has been found that suitable bending can be achieved so long as the lower edge of the forward leg 28 terminates in a plane commensurate with the plane of the underside 16 or is up to a maximum of about the thickness of the workpiece. However, should that distance a be substantially greater than the thickness, during the course of the bending action the material workpiece will pull out of the bending attachment.

The legs 26, 28 are formed of stiff material. However, at the same time they are resilient so that the spacing between the two legs can be varied depending upon the thickness of the material inserted. Accordingly, it is possible to make a plurality of folded hems. Specifically, a piece of sheet material workpiece can be bent partially in the conventional bending brake and subsequently the bend completed to form a hem of 180°. The material can then be reinserted into the conventional bending brake to partially bend over the hem and this can again be completely bent over by means of the bending attachment so as to form a double folded over hem. This procedure can be continued to provide as many folds as desired.

In the process, each time the hemmed edge is inserted in the space 30 between the legs 26, 28, that thickness becomes greater depending upon the number of folds already previously completed. However, because of the resilient nature of the spacing between the legs 26, 28, the space 30 can accommodate this varied thickness, and still provide the additional bending.

Accordingly, it should be appreciated that the bending attachment heretofore described is one which is simple in construction, easy to manipulate, sturdy, and can provide benefits not heretofore achieved in prior art devices.

There has been disclosed heretofore the best embodiments of the invention presently contemplated. However, it is to be understood that various changes and modifications may be made thereto without departing from the spirit of the invention.

I claim:

1. In a portable bending brake having a workpiece bending door and clamping jaws gripping a bending attachment therein, said bending attachment being positioned in the bending brake adjacent the bending door for the additional bending of a previously partially bent sheet material workpiece, the improvement wherein said attachment is one piece, comprising a horizontally oriented elongated base section for mounting in the jaws of the conventional portable brake and having a width extending between an elongated free edge and an opposing elongated proximal edge, and a workpiece holding section vertically upstanding from said base section, said workpiece holding section comprising two fixed elongated opposed parallel legs both substantially perpendicular to said base section and uniformly spaced apart by a dimension substantially less than the width of the base section and approximating the thickness of the workpiece, each of said legs having opposing elongated upper and lower edges, said legs being interconnected at their respective upper edges forming an apex such that said interconnected legs are formed of one continuous piece of sheet material, whereby said legs form a substantially inverted U-shape in cross section for loosely receiving a portion of the workpiece between the legs without clamping the workpiece, the lower edge of one of said legs being interconnected to said elongated proximal edge, with the other leg remaining free, wherein said base section is held in the jaws of the bending brake, so that the holding section extends beyond the grip of the clamping jaws, the holding section being positioned with respect to the bending door such that a portion of the workpiece can be inserted between the legs, and the rest of the workpiece can be bent against the outside of the free leg by the bending door.

2. The bending attachment as in claim 1, wherein said workpiece holding section is integral with said base section, with both sections being formed of one continuous piece of sheet material.

3. The bending attachment as in claim 1, wherein the lower edge of the free leg of said holding section terminates in a common plane with said base section.

4. The bending attachment as in claim 1, wherein the lower edge of the free leg is vertically spaced above the plane of said base section by a distance up to approximately the thickness of the sheet material workpiece.

5. The bending attachment as in claim 1, wherein said legs are formed of resilient material, whereby the legs can spread and converge to accommodate the different thicknesses of the sheet material workpiece.

6. The bending attachment as in claim 5, wherein said resilient material is aluminum.

* * * * *